US007287294B2

(12) United States Patent
Miller et al.

(10) Patent No.: US 7,287,294 B2
(45) Date of Patent: Oct. 30, 2007

(54) METHOD OF MAKING AN EXPANDABLE SHOE

(75) Inventors: Harry Miller, Weston, MA (US); Byong M. Shin, Kimhae-Si (KR); Kwong Dong Chil, Pusan (KR)

(73) Assignee: Harry Miller Co., Inc., Boston, MA (US)

( * ) Notice: Subject to any disclaimer, the term of this patent is extended or adjusted under 35 U.S.C. 154(b) by 0 days.

(21) Appl. No.: 10/972,071

(22) Filed: Oct. 22, 2004

(65) Prior Publication Data

US 2005/0115113 A1 Jun. 2, 2005

Related U.S. Application Data

(60) Provisional application No. 60/513,931, filed on Oct. 24, 2003.

(51) Int. Cl.
*A43B 3/26* (2006.01)
*A43D 29/00* (2006.01)

(52) U.S. Cl. ..... 12/145; 36/97

(58) Field of Classification Search ..... 36/97; 12/142 R, 142 LC, 142 P, 142 T, 145
See application file for complete search history.

(56) References Cited

U.S. PATENT DOCUMENTS

| | | | | |
|---|---|---|---|---|
| 4,497 | A | 5/1846 | Vetter | |
| 524,946 | A | 8/1894 | Kregel | |
| 526,626 | A | 9/1894 | Kregel | |
| 797,966 | A | 8/1905 | Lange et al. | |
| 831,210 | A | 9/1906 | Bosley | |
| 955,337 | A | 4/1910 | Lawlor | |
| 1,539,762 | A | 5/1925 | Mussabini | |
| 1,633,413 | A | 6/1927 | Marca | |
| 1,856,377 | A | 5/1932 | Dettelbach | |
| 2,009,684 | A | 7/1935 | Affronte | |
| 2,112,052 | A | 3/1938 | Smith | |
| 2,113,898 | A | 4/1938 | Nehus | |
| 2,190,864 | A * | 2/1940 | Dawes | 36/51 |
| 2,295,364 | A | 9/1942 | Skorepa | |
| 2,497,175 | A | 2/1950 | Mantos | |
| 2,603,889 | A | 7/1952 | Lahnstein et al. | |
| 2,734,284 | A | 2/1956 | Seurbom | |
| 2,825,109 | A | 3/1958 | Nelson | |
| 3,008,250 | A | 11/1961 | Herunter | |
| 3,057,085 | A | 10/1962 | Rigsby | |
| 3,343,282 | A * | 9/1967 | Sneider | 36/51 |

(Continued)

FOREIGN PATENT DOCUMENTS

| | | |
|---|---|---|
| CA | 2201816 | 10/1998 |

(Continued)

*Primary Examiner*—Ted Kavanaugh
(74) *Attorney, Agent, or Firm*—Black Lowe & Graham PLLC

(57) ABSTRACT

A method of making an expandable shoe is disclosed. An intermediate footwear structure is provided having an expandable upper portion. A stabilizing material is provided to the intermediate structure to resist expansion of the upper portion, and a last is inserted into the intermediate structure. A subsequent manufacturing operation is performed to the intermediate structure, and the stabilizing material is acted upon to permit longitudinal movement of the upper portion. The size of the last is selected from among the sizes within the intended range of shoe sizes for the expandable shoe, depending on the characteristics of the upper portion of the shoe, and the desired shoe size range.

19 Claims, 9 Drawing Sheets

U.S. PATENT DOCUMENTS 3,389,481 A * 6/1968 England ..... 36/97
3,431,658 A 3/1969 Finn
3,436,842 A 4/1969 Sachs
3,442,031 A * 5/1969 Antell ..... 36/97
3,541,708 A 11/1970 Rosen
3,618,235 A 11/1971 Cary, Jr.
3,668,791 A 6/1972 Salzman et al.
3,686,777 A 8/1972 Rosen
3,738,027 A 6/1973 Schoch
3,748,756 A 7/1973 White
3,771,529 A 11/1973 Matteson
3,794,037 A 2/1974 Matteson
3,808,644 A 5/1974 Schoch
3,834,048 A 9/1974 Maurer
3,883,964 A 5/1975 Check
3,922,800 A 12/1975 Miller et al
3,965,544 A 6/1976 Boden
3,997,985 A 12/1976 Shiina
4,060,918 A 12/1977 Mandel
4,083,128 A 4/1978 Rossman
4,120,103 A 10/1978 Colby
4,136,468 A 1/1979 Munschy
4,166,329 A 9/1979 Herbig
4,178,925 A 12/1979 Hirt
4,192,087 A 3/1980 Salomon
4,265,032 A * 5/1981 Levine ..... 36/11.5
4,299,039 A 11/1981 Hanson
4,360,979 A 11/1982 Spademan
4,379,370 A 4/1983 Balbinot
4,426,796 A 1/1984 Spademan
4,433,456 A 2/1984 Baggio
4,510,704 A 4/1985 Johnson
4,523,395 A 6/1985 Borsoi
4,551,932 A 11/1985 Schoch
4,553,342 A 11/1985 Derderian et al.
4,597,125 A * 7/1986 Jones, Jr. ..... 12/142 F
4,615,127 A 10/1986 Delery
4,616,524 A 10/1986 Bidoia
4,619,058 A 10/1986 Gumbert
4,633,599 A 1/1987 Morell et al.
4,653,204 A 3/1987 Morell et al.
4,680,878 A 7/1987 Pozzobon et al.
4,719,670 A 1/1988 Kurt
4,719,709 A 1/1988 Vaccari
4,719,710 A 1/1988 Pozzobon
4,731,940 A 3/1988 Zanatta et al.
4,748,726 A 6/1988 Schoch
4,754,560 A 7/1988 Nerrinck
4,765,070 A 8/1988 Chemello et al.
4,799,297 A 1/1989 Baggio et al.
4,841,649 A 6/1989 Baggio et al.
4,858,341 A 8/1989 Rosen
4,884,760 A 12/1989 Baggio et al.
4,907,354 A 3/1990 Benoit et al.
4,931,773 A 6/1990 Rosen
4,937,952 A 7/1990 Olivieri
4,937,953 A 7/1990 Walkhoff
4,942,678 A 7/1990 Gumbert
4,944,099 A 7/1990 Davis
4,949,479 A 8/1990 Ottieri
4,961,544 A 10/1990 Bidoia
4,967,492 A 11/1990 Rosen
4,969,224 A * 11/1990 Birke ..... 12/142 F
4,969,277 A 11/1990 Williams
4,998,358 A 3/1991 Girardelli
5,036,604 A 8/1991 Rosen
5,042,177 A 8/1991 Schoch
5,060,402 A 10/1991 Rosen
5,062,224 A 11/1991 Tacchetto
5,079,858 A 1/1992 Sartor et al.
5,113,599 A 5/1992 Cohen et al.
5,117,567 A 6/1992 Berger
5,157,813 A 10/1992 Carroll
5,158,767 A 10/1992 Cohen et al.
5,177,882 A 1/1993 Berger
5,181,331 A 1/1993 Berger
5,205,055 A 4/1993 Harrell
5,224,280 A 7/1993 Preman et al.
5,241,762 A 9/1993 Rosen
5,265,349 A 11/1993 Munschy
5,285,584 A 2/1994 Dubner
5,291,671 A 3/1994 Caberlotto et al.
5,319,868 A 6/1994 Hallenbeck
5,325,613 A 7/1994 Sussmann
5,325,614 A 7/1994 Rosen
5,327,662 A 7/1994 Hallenbeck
5,333,398 A 8/1994 Seo
5,341,583 A 8/1994 Hallenbeck
5,345,697 A 9/1994 Queltais
5,351,710 A 10/1994 Phillips
5,355,596 A 10/1994 Sussmann
5,381,609 A 1/1995 Hieblinger
5,384,970 A 1/1995 Melton
5,404,658 A 4/1995 Rosen
5,408,761 A 4/1995 Gazzano
5,437,110 A 8/1995 Goldston et al.
5,459,949 A 10/1995 MacPhail
5,467,537 A 11/1995 Aveni et al.
5,502,902 A 4/1996 Sussmann
5,511,325 A 4/1996 Hieblinger
5,570,523 A 11/1996 Lin
5,599,088 A 2/1997 Chien
5,600,874 A 2/1997 Jungkind
5,657,557 A 8/1997 Hull et al.
5,659,980 A 8/1997 Lin
5,678,325 A 10/1997 Davidowitz et al.
5,682,687 A 11/1997 Arai
5,699,629 A 12/1997 Munschy
5,709,954 A 1/1998 Lyden et al.
5,729,912 A 3/1998 Gutkowski et al.
5,737,854 A 4/1998 Sussmann
5,791,021 A 8/1998 James
5,791,068 A 8/1998 Bernier et al.
5,794,362 A 8/1998 Polk, III et al.
5,809,620 A 9/1998 Crowley et al.
5,813,146 A 9/1998 Gutkowski et al.
6,045,144 A 4/2000 Wong
6,138,385 A 10/2000 Jungkind et al.
6,189,239 B1 2/2001 Gasparovic et al.
6,279,251 B1 8/2001 Davis
6,402,163 B1 6/2002 Pratt
6,438,872 B1 8/2002 Chil et al.
6,817,116 B2 11/2004 Chil et al.

FOREIGN PATENT DOCUMENTS

CA 2201816 A 10/1998
DE 59317 3/1891
DE 59 317 C 10/1891
DE 20205724 7/2002
EP 1112698 A 7/2001
EP 1258268 A 11/2002
FR 27523369 2/1998
GB 913182 A 12/1962
WO WO92/18023 10/1992
WO WO92/28053 9/1996
WO WO 01/33986 5/2001

* cited by examiner

METHOD OF MAKING AN EXPANDABLE SHOE

CROSS REFERENCE TO RELATED APPLICATIONS

This application claims priority under 35 U.S.C. § 119(e) to provisional patent application Ser. No. 60/513,931 entitled, "Method of Making an Expandable Shoe," filed on Oct. 24, 2003.

BACKGROUND OF THE INVENTION

1. Technical Field

The present invention relates to a method of making an expandable shoe.

2. Discussion of Related Art

Some attempts have been made to provide expandable shoes, which can purportedly withstand day-to-day use. U.S. Pat. No. 3,389,481, for example, discloses a shoe in which a two plate assembly is disposed between an inner and a disjointed outer sole, having overlapping front and back portions. One of the plates includes a spring tongue, and the other plate includes two apertures to receive the spring tongue, each aperture corresponding to a shoe size. To adjust the shoe size, a screw which extends through the heel and into the disjointed soles is removed. The shoe may then be pulled apart allowing the disjointed sole to separate until the spring tongue engages the next aperture. Thus the shoe size may be lengthened by one size, but apparently the size cannot be controlled finely or reduced. The shoe includes two crinkled leather portions 34, one on each side of the shoe, to facilitate expansion of the shoe.

WO 01/33986 describes an expandable shoe. The expandable shoe includes an outer shell having a front and a rear outer assembly each attached to a flexible, expandable segment. An adjustable inner assembly is disposed within the outer shell and includes a control mechanism, accessible from the outer shell, that may be urged from a lock state into a state in which the inner assembly and outer shell may be adjusted. A visualization window provides a view port to the inner assembly.

Though WO 01/33986 details a desirable expandable shoe design, certain improvements thereto have been discovered to improve ergonomics, torsional rigidity, handling, and the construction of the shoe.

SUMMARY

Under one aspect of the invention, an expandable shoe is provided which includes a front outer assembly, and a rear outer assembly. An expandable segment attaches to the front and rear outer assemblies to define a shoe outer shell and the expandable segment extends at least partially along each side of the outer shell and transversely across the bottom of the outer shell. An adjustable inner assembly is disposed within the outer shell and has a first board portion and a second board portion in overlapping engagement with each other. The inner assembly also includes a control to adjust the position of the first board portion relative to the second board portion and to thereby adjust a dimension of the inner assembly and thereby a corresponding dimension of the shoe.

Under another aspect of the invention, the control includes a locking mechanism shaped to engage and hold one of the first and second board portions, a biasing mechanism to bias the locking mechanism into engagement with one of the first and second board portions; and an urging member having a proximal portion external of the shoe outer shell and positioned and movable transversely to a longitudinal direction of the shoe and in transverse alignment with the locking mechanism.

Under another aspect of the invention, one of the first and second board portions include transversely extending teeth, and the locking mechanism includes transversely extending teeth and the urging member include a rod portion having at least two diameters. The locking mechanism includes an aperture in alignment with the rod portion and the cross section of the aperture is larger than the smaller of the at least two diameters but smaller than the large of the at least two diameters. When the urging member is moved, the rod portion contacts and moves the locking mechanism with the larger of the two diameters.

Under another aspect of the invention, one of the first and second board portions includes an upward-facing cavity containing the control. The opening to the cavity is covered by the other of the first and second board portions when the first and second board portions overlap.

Under another aspect of the invention, one of the first and second board portions includes at least one groove extending longitudinally and the other of the first and second board portions includes a corresponding rail in alignment with the groove. The rail is positioned within the groove as the first and second board portions overlap.

Under another aspect of the invention, at least one of the first and second board portions includes a lattice support structure.

Under another aspect of the invention, one of the first and second board portions includes an index of notches and the other of the first and second board portions includes a protrusion in longitudinal alignment with the index and extending toward the index. When the first and second board portions are moved relative to one another, the protrusion contacts the notches.

Under another aspect of the invention, a method of manufacturing expandable footwear is provided in which an intermediate footwear structure having an upper portion constructed to be at least expandable in a longitudinal direction is provided; a stabilizing material is provided to the intermediate structure to resist longitudinal expansion of the upper portion; a last is inserted into the intermediate structure; a subsequent manufacturing operation is performed to the intermediate structure; and the stabilizing material is acted upon to permit longitudinal movement of the upper portion.

Under another aspect of the invention the stabilizing material is tape attached to the upper portion.

Under another aspect of the invention, the stabilizing material is an insert disposed within the upper portion.

Under another aspect of the invention, the size of the last is selected from among the shoe sizes within the intended shoe size range, based upon the rigidity of the upper portion and the desired size of the footwear.

DETAILED DESCRIPTION

Certain embodiments of the present invention provide improvements to the ergonomics, torsional rigidity, handling, and construction of the shoe designs disclosed in WO 01/33986. That reference in conjunction with U.S. patent application Ser. No. 09/438,935 is hereby incorporated by reference in its entirety.

Figure 1:
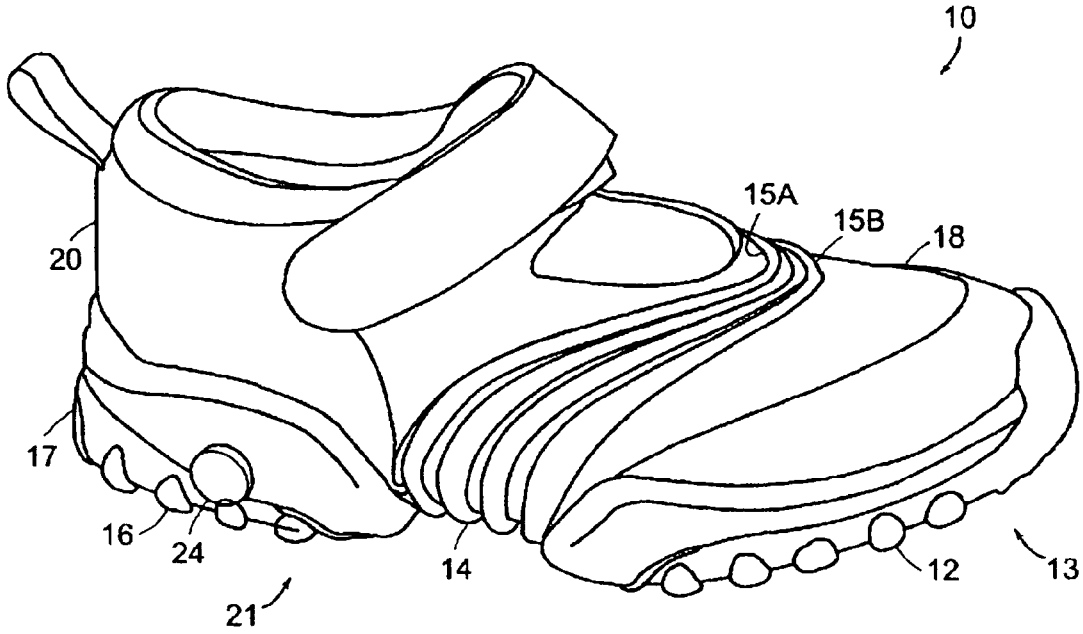
FIGS. 1 and 2 show shoe designs according to certain embodiments of the invention.
Figure 2:
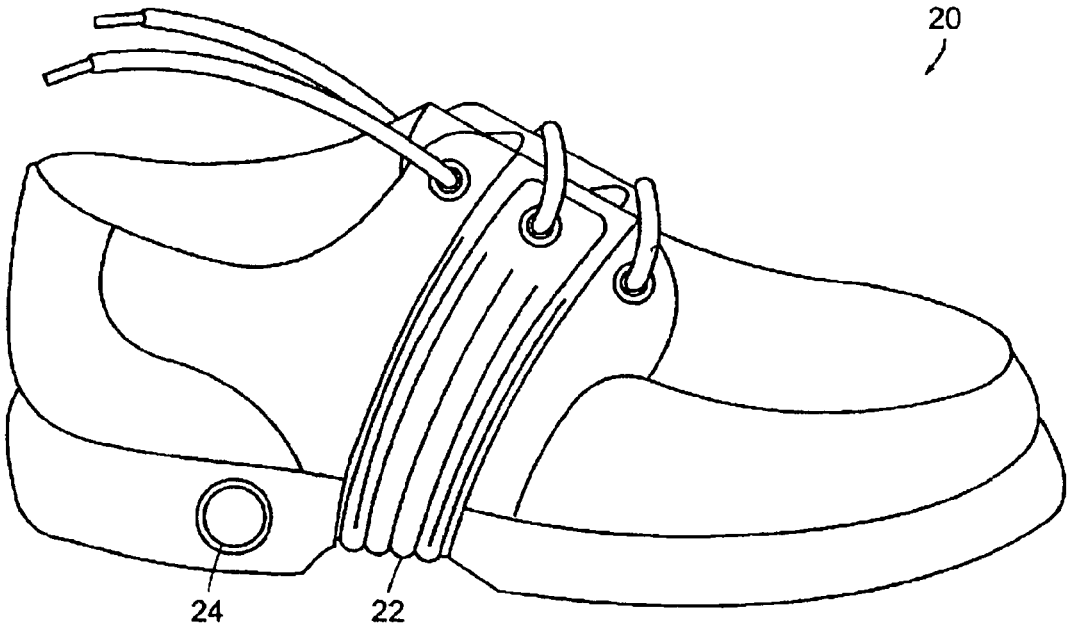

FIGS. 1 and 2 show two shoe designs under certain embodiments of the invention. With reference to FIG. 1, shoe 10 includes a front outer sole 12 and a front upper 18 to form a front outer assembly 13, and a rear outer sole 16 and a rear upper 20 to form a rear outer assembly 17. The front outer assembly 13 is attached to one edge 15B of a bellows segment 14, and the rear outer assembly 17 is attached to a second edge 15A, in each case using conventional techniques, such as by using stitching to the uppers 18, 20 and glue along the outer soles 12, 16. The combination of front outer assembly 13, rear outer assembly 17, and bellows segment 14 forms an outer shell 21.

An alternative shoe 20 is illustrated in FIG. 2. One principal difference in shoe 20 relative to shoe 10 is the bellows 22 of shoe 20 does not completely surround the shoe, whereas bellows 14 of shoe 10 is a unitary bellows enveloping the circumference of the shoe.

Similarly to that described in U.S. patent application Ser. No. 09/438,935, an adjustable inner sole assembly is placed within outer shell 21. An externally-accessible manual control is urged via cap 24 and is used to place the inner sole assembly in a state in which it may be adjusted. When the control is in its natural state (i.e., when it is not urged transversely) it is in a lock state to hold the shoe adjustment fixed.

Figure 3:
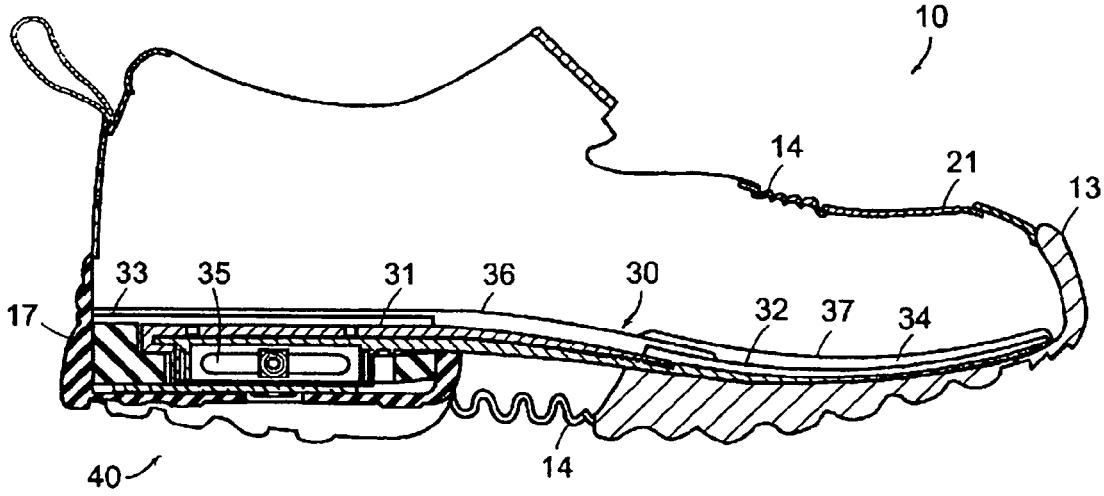
FIG. 3 is a longitudinal cross sectional view of a shoe according to certain embodiments of the invention.

FIG. 3 is a longitudinal cross-sectional view of an exemplary shoe 10. As can be seen in this view, an adjustable inner assembly 30 is positioned within the outer shell 21 and is generally formed from two pieces 31,32 which are shaped to engage and move relative to one another in overlapping relationship. The overlapping and engaging inner assembly 30 provides a relatively rigid last board for desirable foot support. In this embodiment, rear piece 31 is partially positioned within a heel section of the shoe 10 and includes the control mechanism 41, discussed below, which allow the shoe to be adjusted in size. The shoe includes a two piece inner last board 33, 34. This two piece inner last is made from materials, e.g., cloth, used for conventional last boards and is attached or sewn to the outer shell. Over the inner last is a two piece inner sole 36 and 37 made from conventional materials, e.g., foam, and shaped to overlap one another so that the pieces slide as the shoe size is adjusted.

Figure 4A:
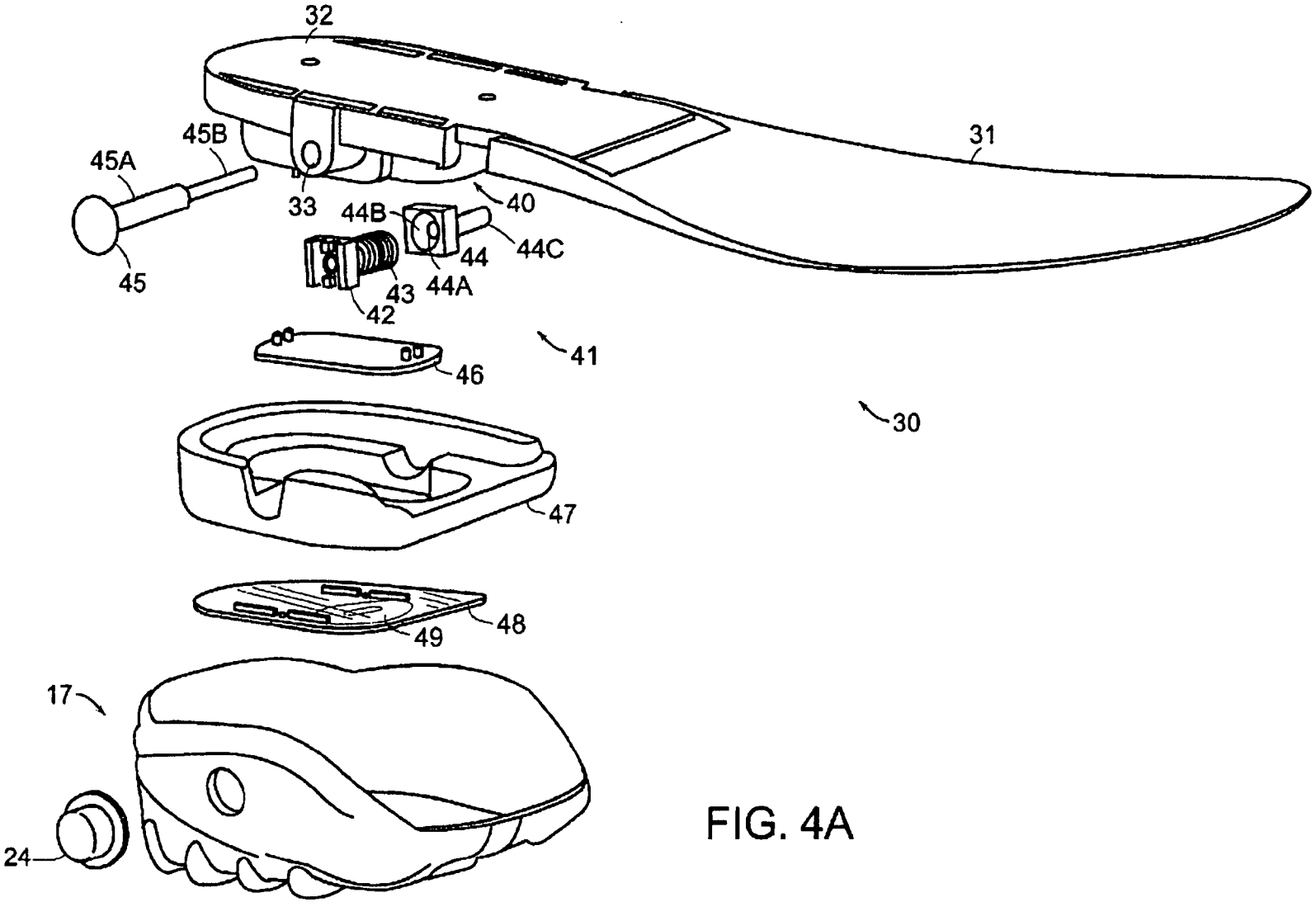
FIGS. 4A-B are exploded views of expandable last boards according to certain embodiments of the invention.

FIG. 4A is an exploded view of one embodiment of the inner assembly 30 in relation to rear outer assembly 17. The inner assembly 30 includes front last board piece 31 and rear last board piece 32 positioned in overlapping, slidable and engaging relationship, as will be described more fully below in connection with the description of other figures. The front piece includes a downward facing cavity 40 (shown better in other figures) into which a control mechanism 41 is positioned. Plate 46 is mounted on the front piece 31 over the cavity 40 and encapsulates the control mechanism within the cavity, protecting it from glue and other substances used in the construction of the entire shoe. On the bottom surface of plate 46, shoe size indicia or adjustment indicia may be printed, engraved, labeled, or the like. The heel portion of the inner assembly 30 is positioned within a heel support 47. A plate 48 having magnification window 49 is fixed to the rear piece 32 by protrusions or the like to align the window 49 with the indicia on the bottom surface of plate 46. Cap 24 is fit over the proximal end of pin 45 and the entire assembly is fit within rear outer assembly 17 and the other components of the outer shell 21.

Figure 4B:
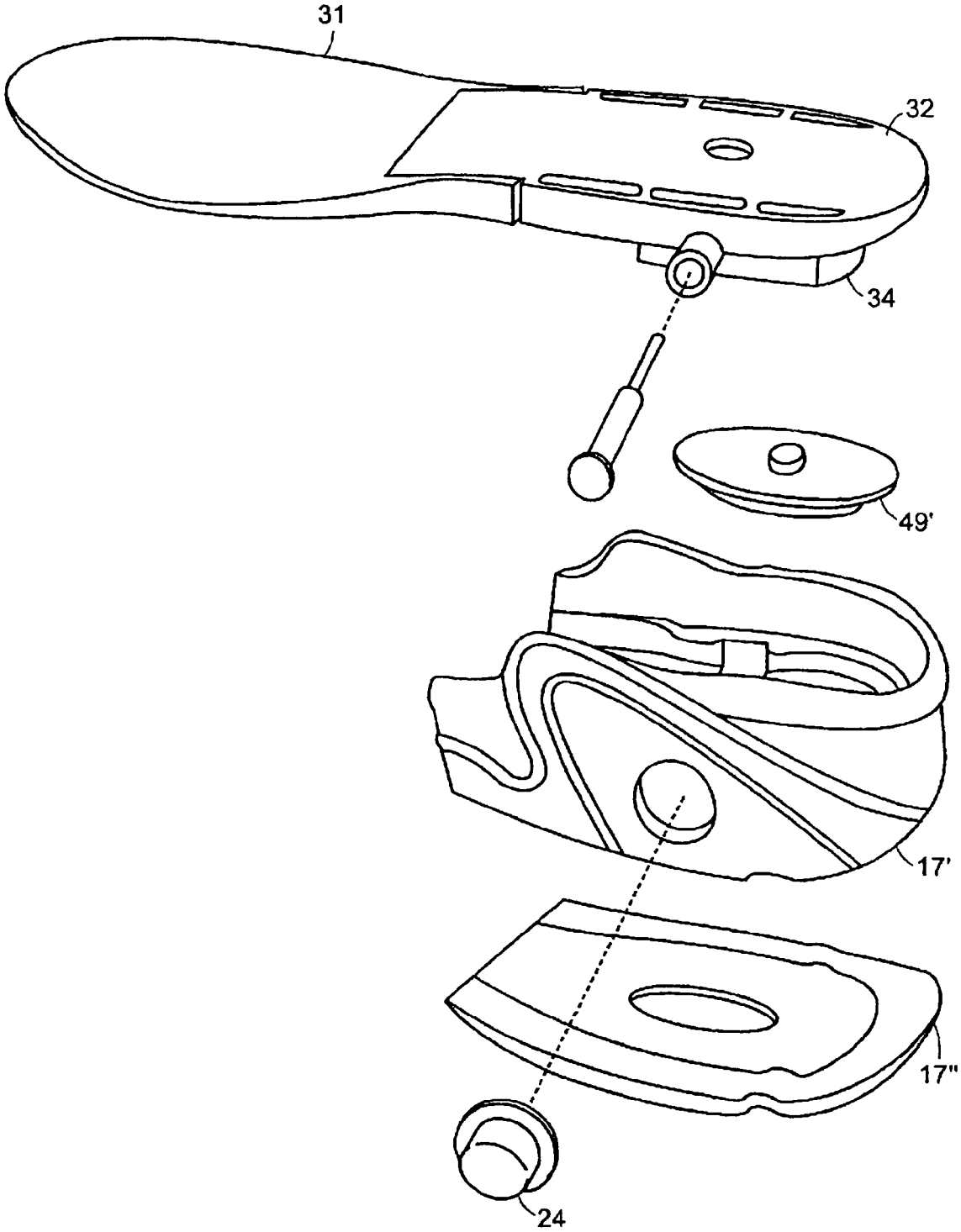

FIG. 4B is an exploded view of another embodiment of the inner assembly 30. In this embodiment, the front piece 31 has an upward facing cavity (not shown) into which the control mechanism is placed. The bottom surface of the cavity is integrated into the front piece 31 (as opposed to an attached plate 46), and the control mechanism is encapsulated by the rear piece 32 being positioned over the opening of the cavity. The bottom surface of the front piece, like the plate 46 of the prior embodiment, includes shoe size indicia or adjustment. The bottom surface 34 of the rear piece 32 has a cutout (not shown), through which the indicia may be observed. In particular, a magnification window 49' is attached to the bottom surface 34 of the rear piece 32 in alignment with the cutout and through which the indicia may be viewed. To illustrate the wide applicability of the design, this figure shows the inner assembly being used with a midsole 17' having an attached outer sole 17".

With reference to FIGS. 3, 4A, 6, and 7, the control mechanism 41 has a natural, locked state in which a toothed member 42 engages teeth 62 integrated with or attached to the front piece. The locked state prevents the front and rear pieces 31 and 32 from being moved longitudinally relative to one another. By sufficiently pushing pin 45 of the control mechanism 41 in a transverse direction relative to the last board's longitudinal direction, the last board may be placed in an unlocked state in which the toothed member 42 disengages the integrated or fixed tooth segment. Consequently, the front piece 31 may be moved longitudinally relative to the rear piece 32. The longitudinal movement is constrained by the extent of the longitudinal apertures 35, one of two of which is shown in FIG. 3. As the front and rear pieces 31, 32 are moved relative to one another, different indicia will align with the magnification window 49, 49'.

Figure 6:
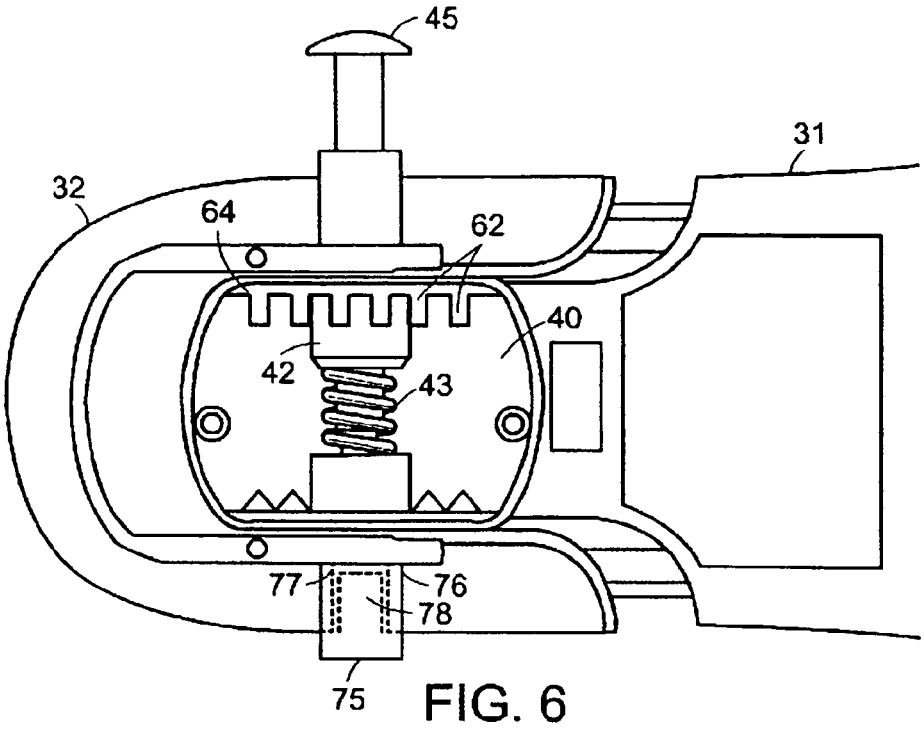
FIGS. 6 and 7 show an exemplary control mechanism in two states.

The control mechanism 41 of either embodiment includes a toothed member 42, a biasing spring 43, a support guide 44, and an urging pin 45. The teeth of the toothed member 42 are shaped and spaced to engage with teeth 62 (shown in FIG. 6 and 7) integrated into or fixed to a wall 64 of the cavity 40 facing the teeth of the toothed member 42. FIG. 6 shows the support guide 44 and spring 43 biasing the toothed member 42 into engagement with the integrated teeth. This "locked" state prevents the front piece from moving longitudinally relative to the rear piece 32.

Figure 7:
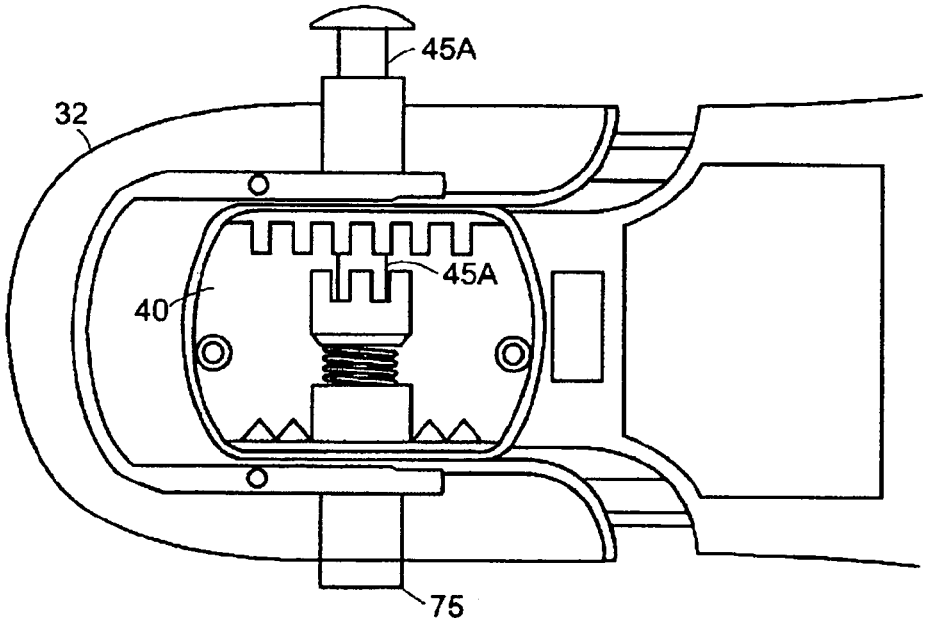

Pin 45 has a first section 45A of a relatively larger diameter and a second section 45B of a relatively smaller diameter. The pin 45 is sized to fit through aperture 33 in rear section 32, through longitudinal slot 35 (shown in FIG. 3), through the control mechanism 41, and into another aperture corresponding to aperture 33 but on the hidden side of the rear section 32. More specifically, the larger diameter section 45A fits through aperture 33 but is too large to fit through the central aperture 42A of toothed member 42. The smaller diameter section 45B, however, is small enough to fit through the central aperture 42A of member 42 and aperture 44A of support 44. The support 44 includes a circular protrusion 44C which defines the aperture 44A and which fits into the aperture corresponding to the aperture 33 but on the hidden side. Thus, as the pin 45 is pushed through the aperture 33, the larger diameter section 45A eventually contacts toothed member 42 but does not pass through it. Continued pushing of pin 45 will thus cause the toothed member 42 to move transversely and compress spring 43 against support 44. Circular recess 44B of support 44 helps keeps the components in secure alignment. Sufficient pushing of the pin 45 will cause the teeth of member 42 to clear and disengage the integrated teeth of front piece 31, as shown in FIG. 7. This "adjustment" state allows the front piece 31 to be moved longitudinally relative to the rear piece 32, while the teeth are so disengaged. The number of teeth and the spacing in between teeth may be made to index to known adjustments. For example, the amount of teeth and spacing may be made to correspond to a range of sizes 13 to 1 and allow half size increments 13, 13.5, 1.

FIGS. 6 and further illustrates an end cap 75. The end cap has a cylindrical protrusion 77 to fit into aperture-defining portion 76 and defines an aperture 78 to receive a distal end of pin 45. The cap further encapsulates the control mechanism protecting it from glue and other debris during manufacturing and use of the shoe.

Though the control mechanism and states are shown and described with reference to the embodiment of FIG. 4A, the operation and components are the same for the embodiment of FIG. 4B. The embodiment of FIG. 4B requires the control mechanism (except for pin 45) to be assembled within the cavity of the front piece 31 before the front piece is arranged with the rear piece but it has the advantage of improved encapsulation and protection from glue used in shoe assembly.

Figure 5A:
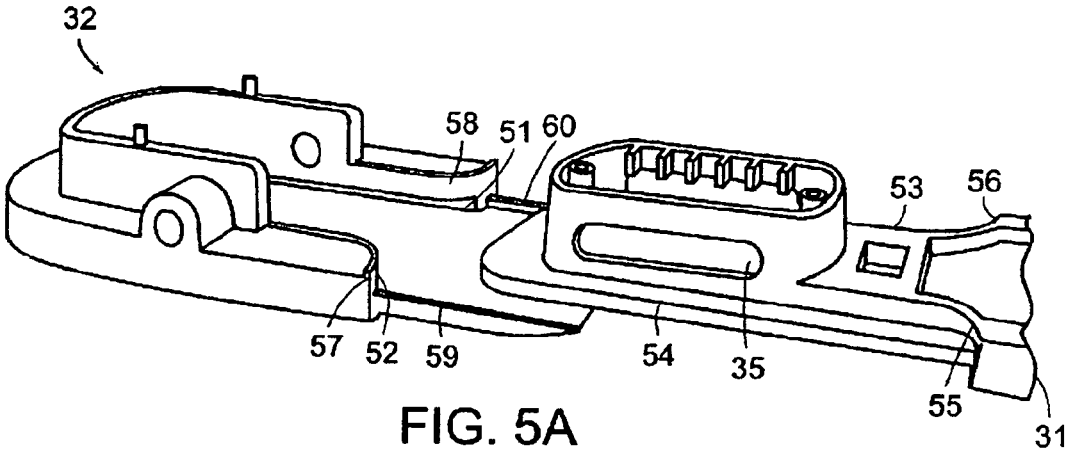
FIGS. 5A-C show features of expandable last boards according to certain embodiments of the invention.
Figure 5B:
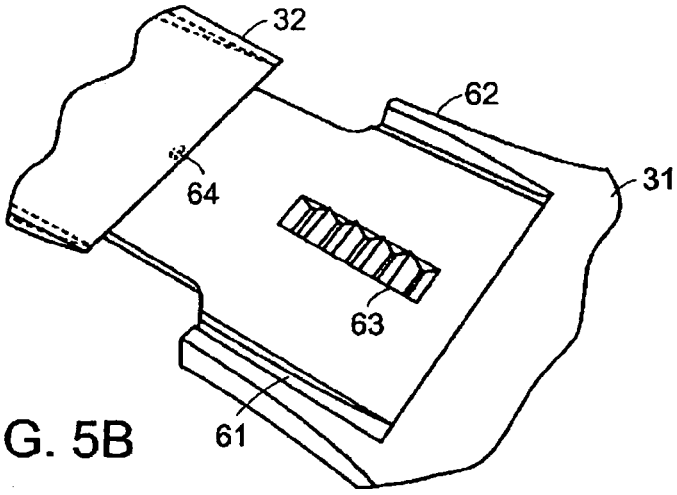
Figure 5C:
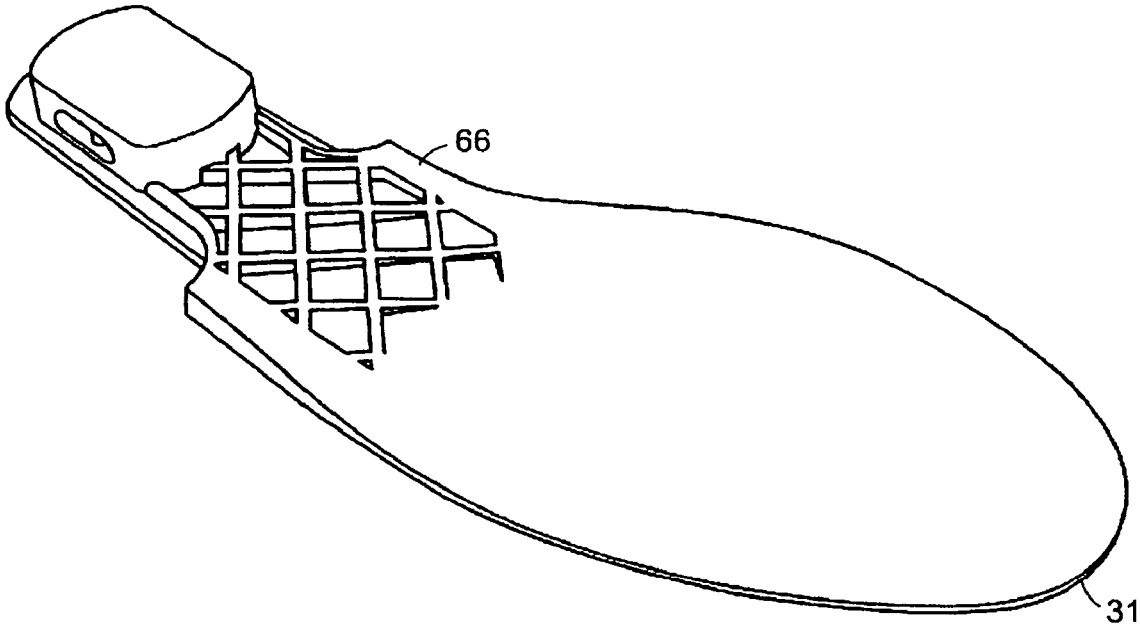

FIGS. 5A-C show certain improvements to the design of the front and rear pieces relative to embodiments shown in WO 01/33986. The rear piece 32 is generally shaped like the rear piece disclosed in WO 01/33986 having slots 51 and 52 to accept the wings 53 and 54 of the front piece 31 so that the front piece may slide within rear piece 32 in an overlapping relationship. When fully contracted curved sections 55 and 56 of the front piece 31 contact curved walls 57 and 58 of the rear piece 32. Unlike the design shown in WO 01/33986, the rear piece 32 includes two rails 59 and 60 protruding up from the major surface of the rear piece 32, and the front piece includes two slots 61 and 62 shaped to receive these rails. Because the rails protrude from the major surface they help inhibit transverse sliding of the front and rear pieces and improve the torsional rigidity of the last board 30.

The top surface of the front piece 31 includes a notched or teeth shaped index 63 and a nib 64 to provide ergonomic feedback to the user when he or she is adjusting the shoe size. The index 64 is in longitudinal alignment with a nib 64 on the underside of rear piece 32. The notches or teeth are positioned to correspond to shoe size adjustments. The nib 64 contacts the teeth or notches of index 63, and thus provides resistance to the user pushing or pulling the two pieces 31,32 together or apart, when the teeth 64 do not align with the teeth of toothed member 42. When the teeth 64 and the toothed member 42 align, the nib will be positioned in a valley or recess of the index 63 and thus provide no resistance to the user, giving the user the tactile sensation of no resistance and signaling that the shoe size adjustment is in alignment.

FIG. 5C shows the bottom surface of front piece 31 and illustrates the lattice-shaped support structure 66 integrated into the front piece. Though other arrangements may be substituted, the structure 66 provides improved torsional rigidity in the midsole area while allowing some of the material of the front piece 31 to be removed and to thus reduce weight.

The shoe designs of FIG. 1 and 2 are exemplary. The principles of the invention may be manifested in embodiments including running shoes, biking shoes, ski boots, dress shoes, snow boarding boots, sandals and the like. Depending on the shoe type, the inner assembly may be in the form of a last board, or a combination of a last board and a midsole, or a midsole. Likewise, depending on the shoe type, the materials used will be selected to provide a desired amount of flexibility or rigidity. Moreover, depending on the shoe design the outer shell may differ. In the case of a sandal, for example, the outer shell would only have strapping. Other embodiments, such as a biking shoe, might have either netting, meshing, or no material where the bellows are shown, thus providing increased ventilation.

Moreover, the above embodiments described a flexible segment made of a bellows-shaped material, but other embodiments may use other materials, e.g., stretchable nylon, netting or meshing, or it may be omitted. Likewise all of the control features described had external features to activate the control, but other embodiment (e.g., cost-reducing embodiments or embodiments where hiding the control is desirable) may place the control mechanisms on the interior of the outer shell.

It is common in the manufacture of shoes to employ a lasting process, in which a last is inserted into an intermediate footwear structure so that a subsequent manufacturing operation or operations may be performed. The last can be used to facilitate any number of manufacturing processes, including gluing a shoe sole to the intermediate structure. After the subsequent manufacturing operation is performed, the last is removed.

Figure 10:
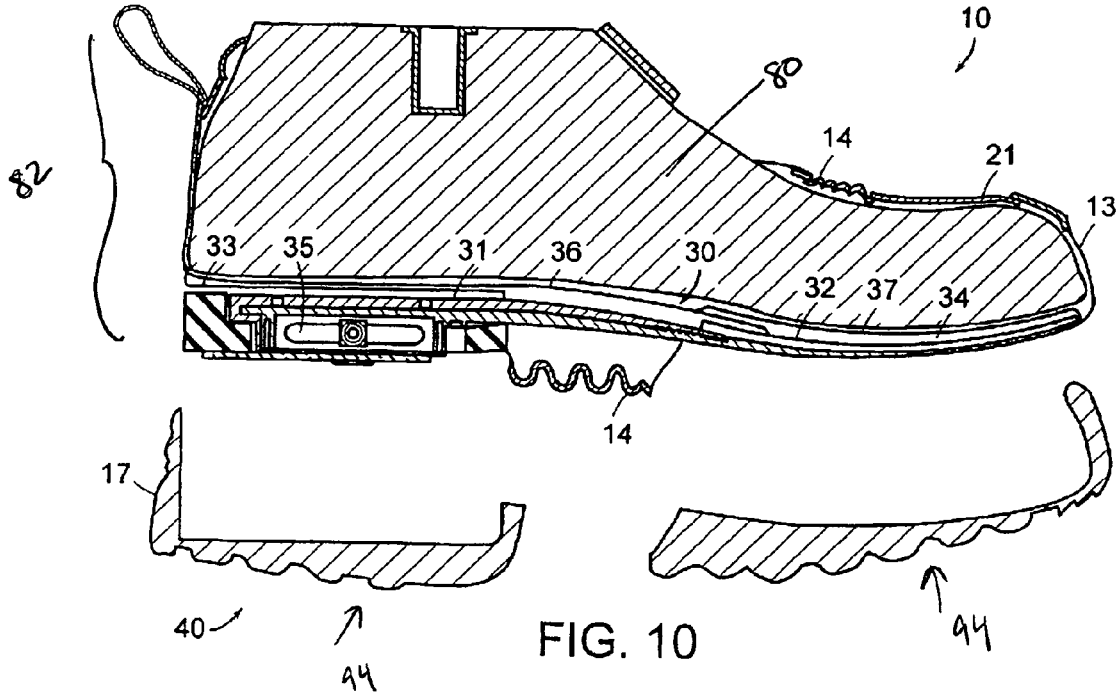
FIG. 10 shows a section view of a shoe during a step in the manufacturing process according to one embodiment of the invention.

FIG. 10 shows a cross sectional view of a last 80 inside an intermediate structure 82 to help keep the intermediate structure 82 firm while a manufacturing process (such as attaching a shoe sole 94 to the intermediate structure 82) is performed. In the embodiment shown in FIG. 10, the intermediate structure 82 includes the upper portion of the shoe as well as the inner assembly, although it is understood that the intermediate structure is not so limited and may be comprised of other components of a shoe.

Figure 12:
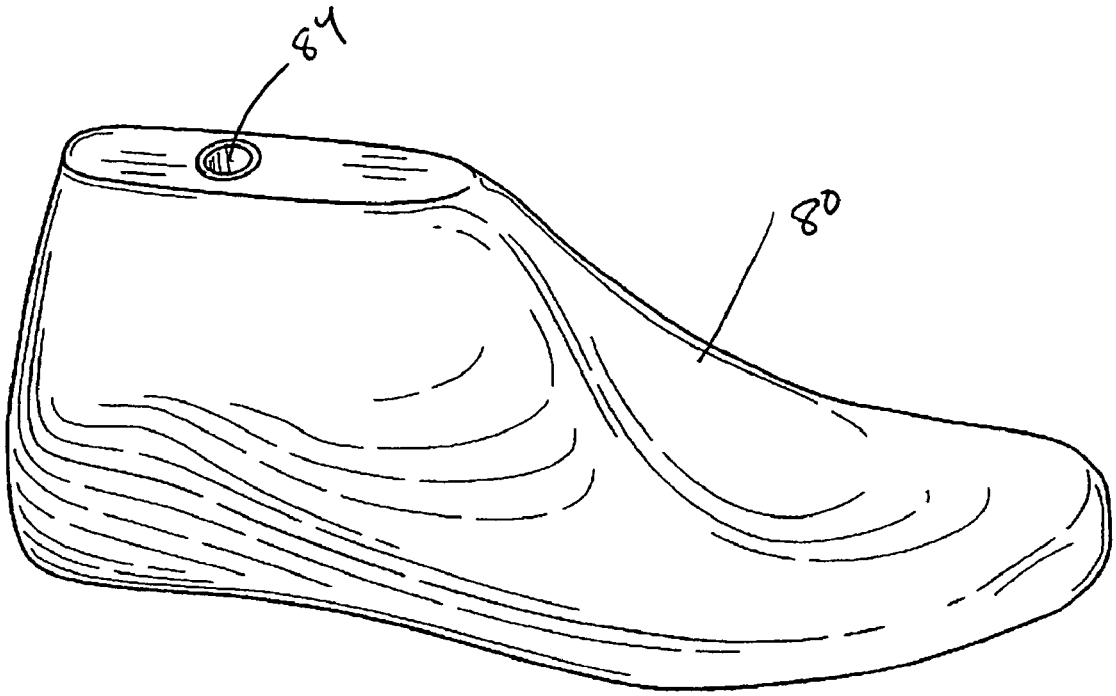
FIG. 12 shows a last according to one embodiment of the invention.

A perspective view of a last 80 is shown in FIG. 12. The shape and size of the last corresponds to the shape and size of the interior of the intermediate structure 82. The last is made of a very sturdy material, and includes a cavity 84 adapted to receive a leverage bar (not shown). The leverage bar is used to facilitate the insertion and removal of the last into the intermediate structure. Since the last 80 is sturdy and corresponds in size to the interior of the intermediate structure 82, the process of inserting the last 80 into the intermediate structure can cause the intermediate footwear structure to deform, especially where the intermediate structure includes a flexible material, such as the bellows segment 14.

To resist deformation of the intermediate structure 82, a stabilizing material is provided to the intermediate structure 82 before the last 80 is inserted. After the required manufacturing operation(s) are performed, the last 80 is removed, and the stabilizing material is acted upon to allow the intermediate structure 82 to become expandable.

Figure 8:
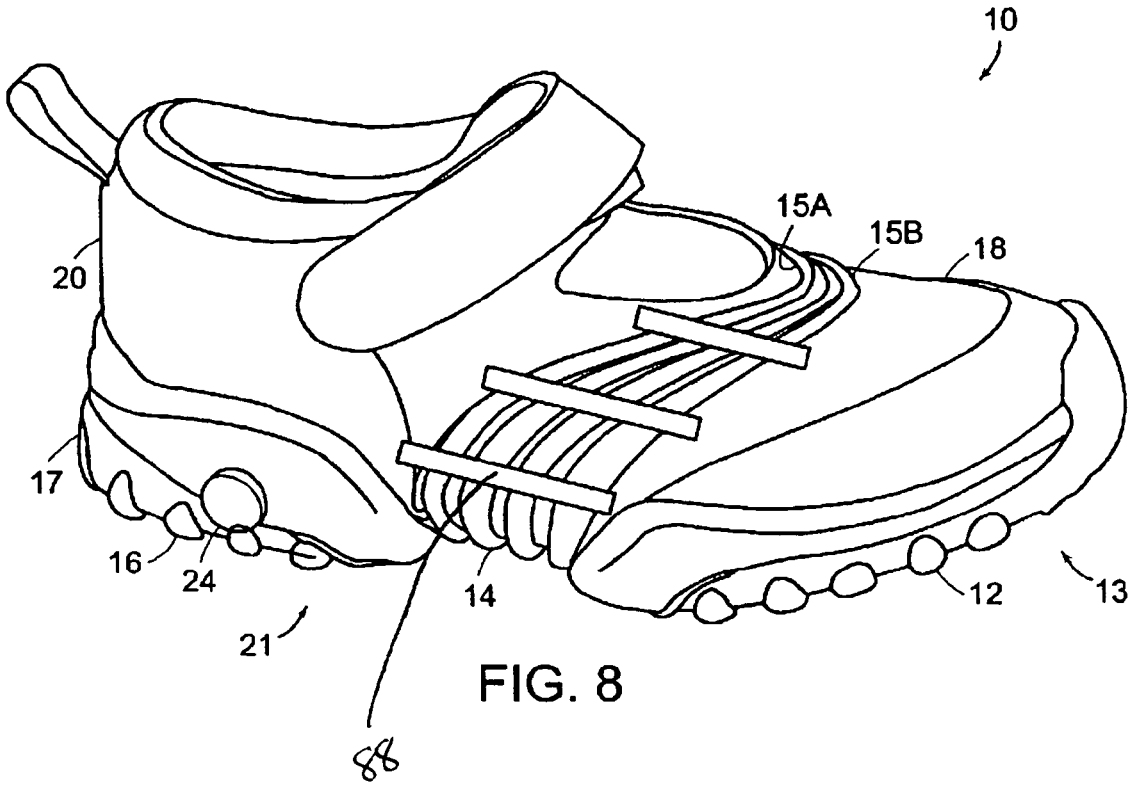
FIG. 8 shows a shoe during a step in the manufacturing process according to the method of one embodiment of the invention.

As noted above, a stabilizing material is provided to the intermediate structure 82 to resist deformation or stretching of the intermediate structure 82 while the last 80 is being inserted and removed. In the embodiment shown in FIG. 8, the stabilizing material is tape 88 that is attached to the bellows segment 14. A suitable tape is a nylon web tape that is stitched to the expandable segment 14. After the shoe sole is attached, and the last is removed, the tape 88 is removed, and the upper portion is able to expand or contract within the confines of the intended shoe size range.

Figure 9:
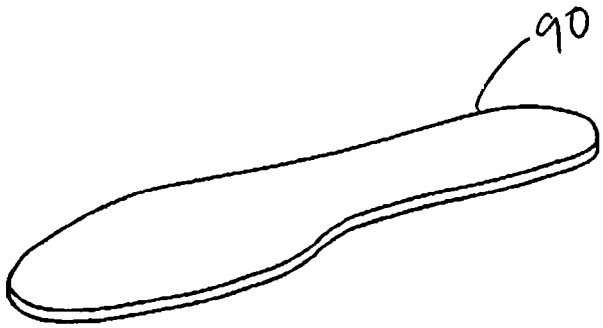
FIG. 9 shoes a perspective view of an insert according to one embodiment of the invention.
Figure 11:
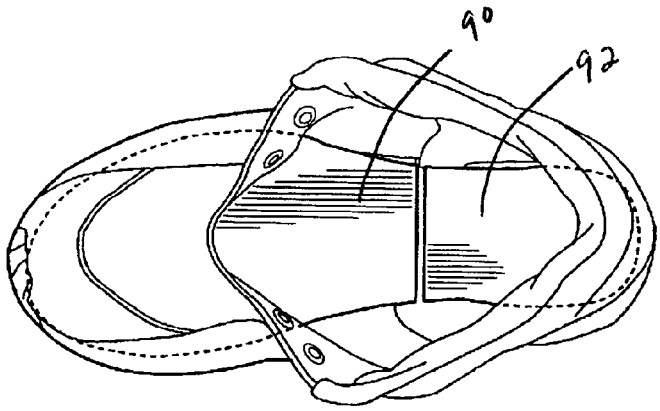
FIG. 11 shows a top sectional view of an insert according to one embodiment of the invention.

In the embodiment shown in FIGS. 9 and 11, the stabilizing materials is a one piece insert 90 that is disposed within the intermediate footwear structure before the last 82 is inserted. A suitable material for the one piece insert 90 is a non-woven bonis material. Other suitable materials include substantially solid lasting materials that resist deformation. After the subsequent manufacturing operation is performed, the last 80 is removed and the one piece insert is cut into two pieces 90, 92 as shown in FIG. 11. This cut allows the two pieces 90, 92 to overlap as the shoe goes from the lasted size to a smaller size, thus avoid a crinkling effect that would occur if the insert were to remain in one piece.

According to one embodiment of the invention, the size of the last used in the lasting process corresponds to one of the sizes within the intended range of sizes for the shoe. The exact choice of size will depend on the characteristics of the intermediate footwear structure, and the desired shoe size range. In the manufacture of the shoe embodiments described above having expandable upper portions, it has been found that if the upper portion of the expandable segment is stiff, and the last corresponds to a small shoe size within the intended range of shoe sizes, the finished shoe may not be flexible enough to fully expand to the larger size of the intended range of sizes. Similarly, if the expandable segment is very flexible, and the last corresponds to a large shoe size within the intended range of shoe sizes, the finished shoe may not be firm enough when it is in the smaller size of the intended range. Thus, according to one embodiment of the invention, where the expandable segment is made of a very flexible material, the size of the last corresponds to the smallest size within the intended size range for the shoe; where the expandable segment is very stiff, the size of the last corresponds to the largest size within the intended size range for the shoe; and where the expandable segment is neither particularly flexible nor stiff, the size of the last corresponds to the middle size within the intended size range for the shoe. For example, where the shoe is expandable from a size 13 to 1 (i.e., 13, 13.5 and 1), the shoe is lasted in size 13 if the expandable segment is particularly flexible, in size 13.5 if the expandable segment is of moderate flexibility and stiffness; and in size 1 if the expandable segment is particularly stiff.

While the invention has been described in connection with certain preferred embodiments, it will be understood that it is not intended to limit the invention to those particular embodiments. On the contrary, it is intended to cover all alternatives, modifications and equivalents as may be included in the appended claims. Some specific components, figures and types of materials are mentioned, but it is to be understood that such component values, dimensions and types of materials are, however, given as examples only and are not intended to limit the scope of this invention in any manner.

What is claimed is:

1. A method of manufacturing expandable footwear comprising:

providing an upper portion comprising unattached first and second upper portions forming an upper shoe;

securing a stabilizing material to the first and second upper portions to prohibit separation of the first and second upper portions during a manufacturing process;

securing an adjustable sole to the first and second upper portions, the adjustable sole being distinct from the stabilizing member; and acting upon the stabilizing material to permit separation of the first and second upper portions after the manufacturing process is completed.

2. The method of manufacturing expandable footwear of claim 1 wherein the step of providing stabilizing material comprises attaching tape to the upper portion.

3. The method of manufacturing expandable footwear of claim 2 wherein the upper portion includes an expandable segment and the tape is attached to the expandable segment.

4. The method of manufacturing expandable footwear of claim 2 wherein the tape is attached to the upper portion with an adhesive material.

5. The method of manufacturing expandable footwear of claim 2 wherein the tape is attached to the upper portion by stitching.

6. The method of manufacturing expandable footwear of claim 1 wherein the step of providing stabilizing material comprises disposing an insert within the upper portion.

7. The method of manufacturing expandable footwear of claim 6 wherein the insert is made of bonis material.

8. The method of manufacturing expandable footwear of claim 6, wherein the insert is made of a substantially solid lasting material.

9. The method of manufacturing expandable footwear of claim 6, wherein the insert has a long axis extending between the first and second upper portions and wherein the step of acting upon the stabilizing materials comprises cutting the insert substantially perpendicularly to the long axis.

10. The method of manufacturing expandable footwear of claim 9, wherein the step of cutting the insert comprises cutting the insert into two pieces.

11. A method of manufacturing expandable footwear comprising:

providing an upper portion comprising first and second upper portions forming an upper shoe;

securing a stabilizing material to prohibit separation of the first and second upper portions during a manufacturing process;

securing an adjustable sole to the first and second upper portions, the adjustable sole being distinct from the stabilizing member;

performing a manufacturing process comprising the steps of inserting a body into the upper portion, attaching a bottom portion to the upper portion to form footwear, and removing the body from the footwear; and acting upon the stabilizing material to permit separation of the first and second upper portions after the manufacturing process is completed.

12. The method of manufacturing expandable footwear of claim 11 wherein after the manufacturing process is completed, the footwear is expandable from at least a first shoe size and a second shoe size.

13. The method of manufacturing footwear of claim 11 wherein after the manufacturing process is completed, the footwear is expandable from at least a first shoe size to a second shoe size and a third shoe size.

14. The method of manufacturing footwear of claim 13 wherein the body corresponds in size to the first shoe size.

15. The method of manufacturing footwear of claim 13 wherein the body corresponds in size to the second shoe size.

16. The method of manufacturing footwear of claim 13 wherein the body corresponds in size to the third shoe size.

17. The method of claim 11 further comprising the step of selecting a size of the body from among the following sizes: a size corresponding to the first shoe size; a size corresponding to the second shoe size; and a size corresponding the third shoe size.

18. The method of claim 11 wherein the body is a last.

19. A method of manufacturing expandable footwear comprising:

providing an upper portion comprising unattached first and second upper portions forming an upper shoe;

securing an insole to the first and second upper portions to prohibit separation of the first and second upper portions during a manufacturing process; and cutting the insole to create separate heel and toe portions to permit separation of the first and second upper portions after the manufacturing process is completed, the toe portion positioned primarily within the first upper portion and the heel portion positioned primarily within the second upper portion.

* * * * *